US009068417B2

(12) United States Patent
Swenson et al.

(10) Patent No.: US 9,068,417 B2
(45) Date of Patent: Jun. 30, 2015

(54) PRESSURE CYCLE INDEPENDENT INDEXER AND METHODS

(71) Applicant: Schlumberger Technology Corporation, Sugar Land, TX (US)

(72) Inventors: Brad Swenson, Houston, TX (US); Richard T. Caminari, Rosharon, TX (US); Oguzhan Guven, Bellaire, TX (US); Josh Grosman, Stafford, TX (US); James Gregory Braeckel, Pearland, TX (US); Ricardo Martinez, Spring, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 193 days.

(21) Appl. No.: 13/656,480

(22) Filed: Oct. 19, 2012

(65) Prior Publication Data

US 2013/0105172 A1 May 2, 2013

Related U.S. Application Data

(60) Provisional application No. 61/552,283, filed on Oct. 27, 2011.

(51) Int. Cl.
*E21B 23/00* (2006.01)

(52) U.S. Cl.
CPC ..... *E21B 23/006* (2013.01)

(58) Field of Classification Search
USPC ..... 166/370, 53, 331, 319, 321, 320, 374, 166/381, 332.2, 332.3, 240
See application file for complete search history.

(56) References Cited

U.S. PATENT DOCUMENTS

| | | | | |
|---|---|---|---|---|
| 7,594,542 | B2 | 9/2009 | Loretz | |
| 7,730,953 | B2 | 6/2010 | Casciaro | |
| 2007/0251697 | A1 * | 11/2007 | Loretz et al. | 166/374 |
| 2009/0159290 | A1 | 6/2009 | Lauderdale | |
| 2011/0114324 | A1 | 5/2011 | Hayter | |

* cited by examiner

*Primary Examiner* — David Bagnell
*Assistant Examiner* — Taras P Bemko

(57) ABSTRACT

Pressure cycle independent indexer devices and methods include an indexing logic having a trigger sequence path defining a pressure event (e.g., one or more pressure events) between a starting slot and an actuation slot and each pressure event being located between a sequence transition point from an incoming sequence leg into an outgoing sequence leg of the trigger sequence path and a return transition point from the trigger sequence path into a return path. The indexing logic may permit cycling hydraulic pressures in a well without inadvertently cycling through the trigger sequence path.

13 Claims, 17 Drawing Sheets

PRESSURE CYCLE INDEPENDENT INDEXER AND METHODS

BACKGROUND

This section provides background information to facilitate a better understanding of the various aspects of the disclosure. It should be understood that the statements in this section of this document are to be read in this light, and not as admissions of prior art.

Hydrocarbon fluids such as oil and natural gas are obtained from a subterranean geological formation, referred to as a reservoir, by drilling a well that penetrates the hydrocarbon-bearing formation. Once a wellbore is drilled forms of well completion components may be installed in order to control and enhance efficiency of producing fluids from the reservoir. Some the equipment that is installed may make use of indexers for control.

SUMMARY

According to some embodiments, a pressure cycle independent indexer includes an indexing pattern having a trigger sequence path defining a pressure event (e.g., one or more pressure events) between a starting slot and an actuation slot and each pressure event being located between a sequence transition point from an incoming sequence leg into an outgoing sequence leg of the trigger sequence path and a return transition point from the trigger sequence path into a return path. In some embodiments, each pressure event is associated with a pressure range between a first pressure value associated with the sequence transition point and a second value associated for example with the return transition point. In accordance with an embodiment, the indexing pattern defines the return path to move the pin from the trigger sequence path to the starting slot in response to the pressure signal exceeding a high threshold pressure value and/or a low threshold pressure value.

An example of a downhole tool in accordance to an embodiment includes a tool member operable from a first position to a second position and a mandrel operably coupled to the tool member, the mandrel axially moveable in response to a pressure signal including an increasing pressure signal and a decreasing pressure signal and an indexer device coupled with the mandrel, including a pin moveable in response to the pressure signal along an indexing pattern that permits movement of the mandrel to operate the tool member to the second position when the pin is positioned in an actuation slot. The indexing pattern includes a trigger sequence path defining a pressure event between a starting slot and the actuation slot, the pressure event defined between a sequence transition point from an incoming sequence path and an outgoing sequence path and a return transition point into a return path. In accordance with some embodiments, the downhole tool is a formation isolation valve operable from a closed position to an open position. In accordance with some embodiments, the pressure cycle independent indexed downhole tool allows for the pressure in the well, for example the tubing pressure, to be cycled without inadvertently actuating the tool member from the first position to the second position. In some embodiments, the indexing pattern defines the return path to move the pin out of the trigger sequence path, for example to the starting slot, in response to a pressure signal exceeding a high and/or a low threshold pressure value.

An example of a method of operating a downhole valve positioned in a wellbore having a tubing includes cycling hydraulic pressure signals in the tubing by increasing the tubing pressure and decreasing the tubing pressure; moving a pin along an indexer pattern operationally coupled with the downhole valve in response to cycling the hydraulic pressure signal; the indexer pattern includes a trigger sequence path extending from a starting slot to an actuation slot and defining a pressure event between a sequence transition point from an incoming sequence leg and an outgoing sequence leg and a return transition point into a return path; indexing the pin through the trigger sequence path into the actuation slot; and operating the downhole valve from a first position to a second position in response to the pin being indexed into the actuation slot.

The foregoing has outlined some of the features and technical advantages in order that the detailed description of the pressure cycle independent indexer and methods that follows may be better understood. Additional features and advantages of the pressure cycle independent indexer and methods will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
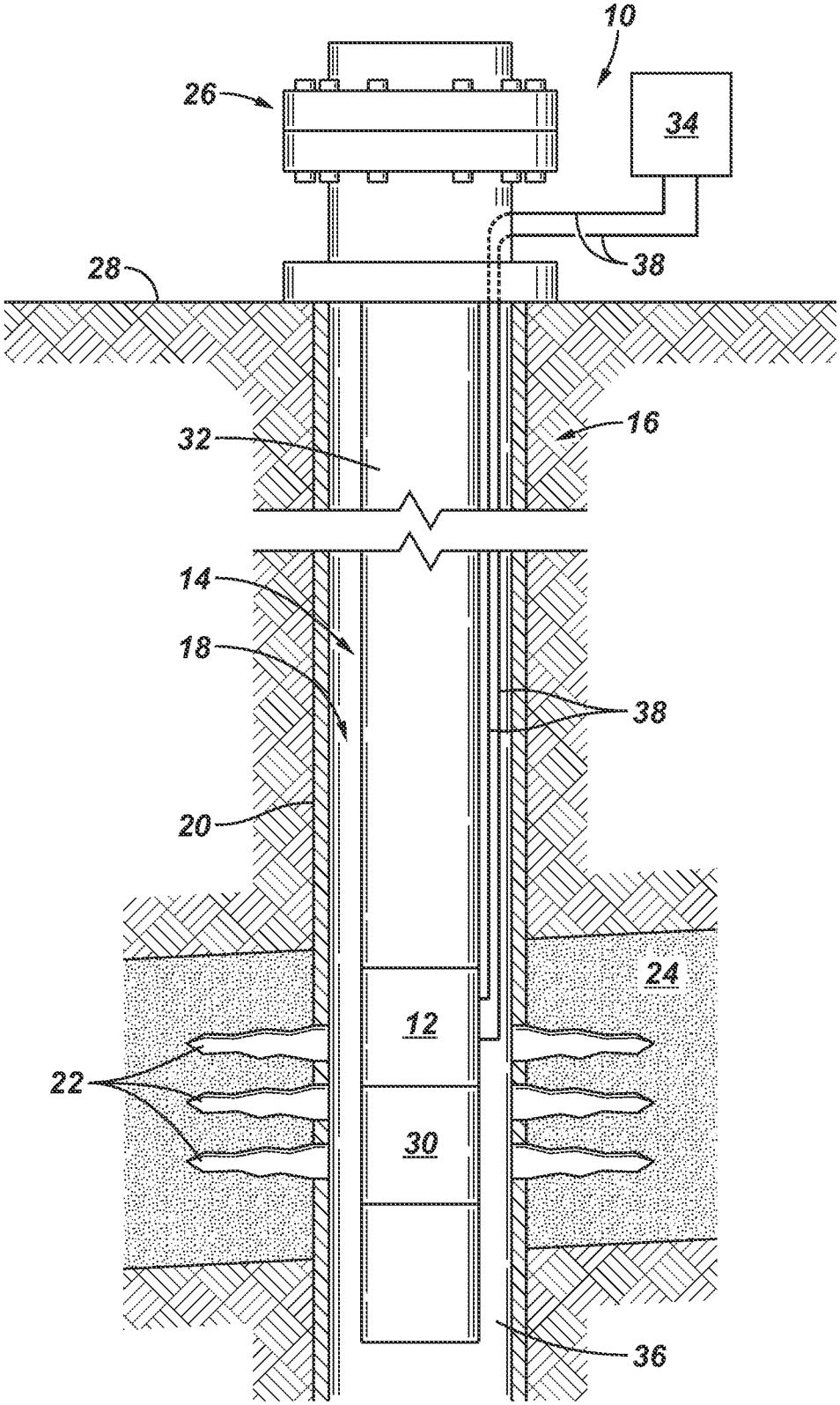
FIG. 1 illustrates a well system in which embodiments of pressure cycle independent indexers and methods can be utilized.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

A formation isolation valve is a type of downhole tool used at least in the lower completion of wells to isolate the formation from the tubing string. FIVs are opened remotely using surface applied tubing pressure cycles. The applied pressure acts against a spring (gas, mechanical, fluid, etc.) in the FIV to axially displace a cycle mandrel relative to sleeve or housing. As the cycle mandrel translates back and forth with each pressure up and subsequent bleed down, a pin and J-slot mechanism that is tied to the cycle mandrel and corresponding sleeve "counts" the number of applied cycles. The pin tracks along the J-slots with each pressure up and bleed down. The geometry (i.e., logic) of the J-slots dictates the rotation of the cycle mandrel relative to the sleeve. The cycle mandrel and sleeve have respective lugs that align and shoulder against each other to constrain the axial translation of the cycle mandrel. The last J-slot in the J-slot sequence misaligns the lugs and allows the spring force to translate the cycle mandrel further in one direction than previously allowed and thereby actuate the downhole tool. This is known as the "long slot" and actuation (opening) of the FIV occurs on this pressure cycle bleed down.

Embodiments of pressure cycle independent indexers, methods, tools and systems are disclosed and described by way of non-exclusive examples illustrated in the various figures. With reference to the figures, embodiments of pressure cycle independent indexers, generally denoted by the numeral 12, comprise a J-slot logic 50 (i.e., geometry) that has a trigger sequence path 84 that defines a sequence of pressure events PE that must be achieved to actuate the connected downhole tool, for example a formation isolation valve. In accordance with some embodiments, if the pressure event sequence is not achieved, the event count, or cycle count, for the trigger sequence will be reset at the beginning of the trigger sequence path or at a position on the path preceding the failed pressure event.

In accordance with one or more embodiments, pressure cycle independent indexer 12 does not limit the maximum number of pressure cycles that can be applied after the pressure cycle independent indexer 12 is deployed in the well (i.e., run-in-hole). For example, a J-slot logic 50 of a pressure cycle independent indexer 12 having a trigger sequence path defining a sequence of four pressure events does not limit well operations to four or fewer pressure events occurring in the well without either pressure cycle independent indexer 12 being actuated or having to pull out of the hole and reset the indexer. Accordingly, embodiments of the pressure cycle independent indexer 12 permit well operations to be performed without concern for inadvertently actuating the downhole tool that is indexed with the pressure cycle independent indexer 12.

In some embodiments, the J-slot logic defines one or more sequence reset pressure thresholds whereby achieving, e.g., exceeding, the pressure threshold resets the event count of the pressure event sequence. In accordance to at least one embodiment, a sequence reset pressure threshold is a low pressure value whereby bleeding the applied pressure below the low pressure value exceeds the sequence reset pressure threshold and the event count of the defined pressure event sequence may be reset to a preceding position. In some embodiments, the J-slot logic sequence reset pressure threshold is a high pressure value. In some embodiments of operating a pressure cycle independent indexed downhole tool, a reset threshold value may be intentionally exceeded to reset the event count. For example, it may be desired to ensure that the pressure event sequence is not inadvertently being processed or it may be desired to ensure that the event count is at zero in order that the pressure event sequence may be initiated to actuate the pressure cycle independent indexed downhole tool.

In at least one embodiment of the pressure cycle independent indexer 12, the entire J-slot logic is formed on a cycle mandrel having a diameter of about one (1) inch (2.54 cm) or less. In some embodiments, the entire J-slot logic is formed on a cycle mandrel having a diameter greater than one inch. In some embodiments, pressure cycle independent indexer 12 incorporates the J-slot logic and pressure event sequence on more than one cycle mandrel. In accordance with some embodiments, the J-slot logic may be formed in sections on more than one cycle mandrel and/or on axial sections of a cycle mandrel. In some embodiments for example, the pressure cycle independent J-slot logic is formed on two or more cycle mandrels each having a diameter of about one (1) inch (2.54 cm) or less.

FIG. 1 illustrates a well system 10 in which pressure cycle independent indexers 12 and methods may be utilized. The illustrated well system 10 comprises a well completion 14 deployed for use in a well 16 having a wellbore 18. Wellbore 18 may be lined with casing 20 for example having openings 22 (e.g., perforations, slotted liner, screens) through which fluid is able to flow between the surrounding formation 24 and wellbore 18. Completion 14 is deployed in wellbore 18 below a wellhead 26 disposed at a surface 28 (e.g., terrestrial surface, seabed).

Completion 14 includes a downhole tool 30 deployed in wellbore 18 for example by a conveyance 32 (e.g., tubular string) depicted and described in some embodiments as tubing 32. Downhole tool 30 is a device having two or more operating positions, for example, open and closed positions for controlling fluid flow, partially opened (e.g., choked) fluid control positions, and on and off positions. Examples of downhole tool 30 include without limitation, valves such as formation isolation valves ("FIV"), inflow-outflow control devices ("ICD"), flow control valves ("FCV"), chokes and the like, as well other downhole devices. A downhole tool 30 coupled with or incorporating pressure cycle independent J-slot logic may be referred to herein as an indexed downhole tool.

Downhole tool 30 is actuated or moved from one operating position to another by pressure cycle independent indexer 12 operatively connected to downhole tool 30. In accordance with some embodiments, pressure cycle independent indexer 12 prevents the actuation of an indexed downhole tool 30 from one position to another position, for example from closed to open, until pressure cycle independent indexer 12 has been cycled through the defined pressure event sequence.

Pressure cycle independent indexer 12 is actuated in response to cycling hydraulic pressure signals through a sequence of hydraulic pressure events. As will be understood by those skilled in the art with benefit of this disclosure, hydraulic pressure signals may be applied to pressure cycle independent indexer 12 for example by a hydraulic source 34 (e.g., pump) which may be located for example at or above surface 28, for example on a marine platform or drilling vessel. Hydraulic pressure may be applied to pressure cycle independent indexer 12 for example through tubing 32, the wellbore annulus 36, and/or one or more control lines 38. In some embodiments the hydraulic pressure signal includes the application of hydraulic pressure and the removal of hydraulic pressure and the pressure change is associated with the change in direction of the pressure signal for example from pressuring up to bleeding down and from bleeding down to pressuring up.

Figure 2:
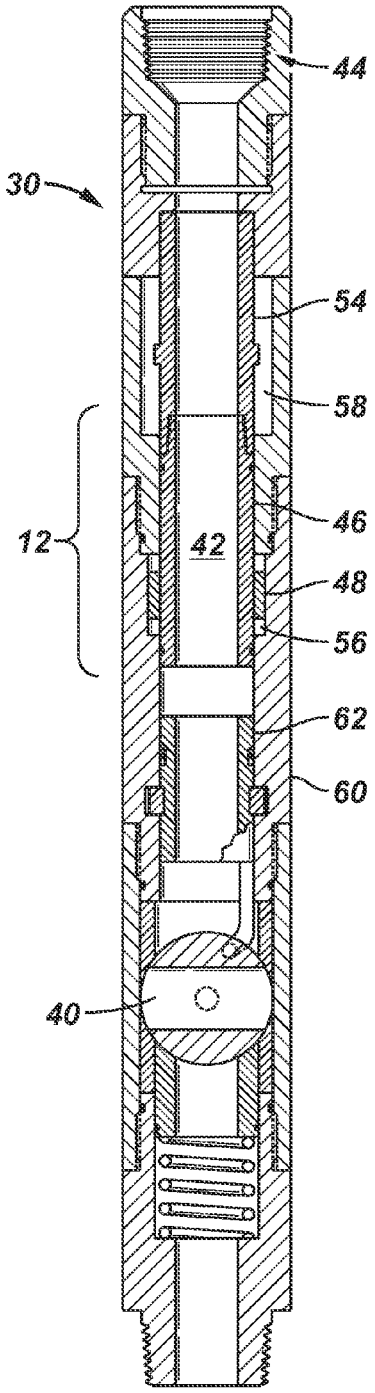
FIG. 2 illustrates an example of a downhole tool incorporating a pressure cycle independent indexer in accordance with one or more embodiments.

FIG. 2 illustrates an example of a downhole tool 30 depicted as a formation isolation valve ("FIV") utilizing a pressure cycle independent indexer 12 in accordance to one or more embodiments. Downhole tool 30 includes a valve closure member 40 depicted as a ball. Valve closure member 40 is illustrated in a closed position blocking fluid flow through axial bore 42. Referring to FIGS. 1 and 2, downhole tool 30 includes threaded ends 44 for connecting to tubing 32 and forming axial bore 42 through tubing 32 and downhole tool 30.

Figure 3:
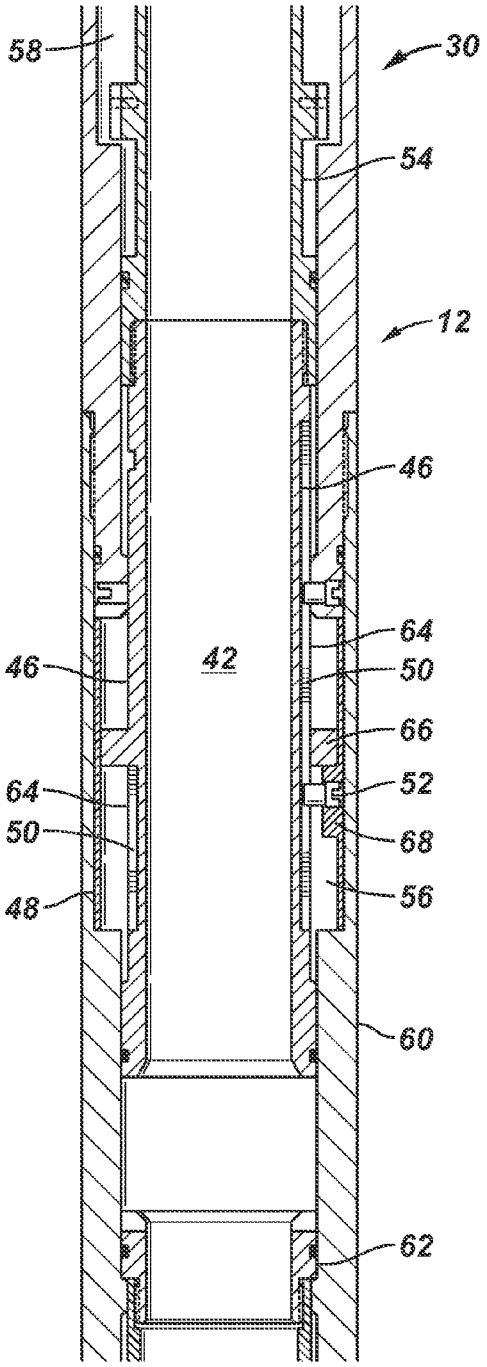
FIG. 3 illustrates an expanded view of an example of the pressure cycle independent indexer section coupled with a downhole tool in accordance with one or more embodiments.

Referring to FIGS. 2 and 3, an embodiment of a pressure cycle independent indexer 12 includes a cycle mandrel 46 disposed with a housing or sleeve 48. Cycle mandrel 46 and sleeve 48 are operationally connected by a J-slot logic 50 (i.e., indexing pattern) and J-slot pin 52 (e.g., detent, finger). In the depicted embodiment, cycle mandrel 46 is connected with an operator mandrel 54. Reference to cycle mandrel 46 and sleeve 48 in the singular does not limit pressure cycle independent indexer 12 to the use of a single cycle mandrel 46 and sleeve 48 operationally connected by J-slot logic 50. For example, pressure cycle independent indexer 12 may include two or more cycle mandrels 46 and sleeves 48 operationally connected by J-slot logic 50, or for example two or more cycle mandrels aligned axially within a sleeve 48, or two or more sleeves axially aligned about a single cycle mandrel. The cycle mandrel-sleeve combinations may be positioned axially one after another and each operated through the J-slot logic to complete the defined trigger sequence and actuate the tool member of indexed downhole tool 30.

Hydraulic pressure applied to tubing 32 (FIG. 1) is communicated through axial bore 42 and it can be communicated to a first chamber 56. The applied pressure acts upward on cycle mandrel 46 in the example illustrated in FIG. 3 and against a spring 58 (e.g., gas, mechanical, hydraulic, etc.) to axially translate cycle mandrel 46 relative to sleeve 48 and housing 60. For example, when the applied hydraulic (i.e., fluid) pressure at first chamber 56 exceeds the spring 58 (i.e., reference pressure) force, cycle mandrel 46 moves axially in a first direction. When the tubing 32 pressure is bled down the force applied by spring 58 causes cycle mandrel 46 to move in a second direction opposite from the first direction. The axial travel of cycle mandrel 46 is limited by the J-slot logic 50. Operator mandrel 54 is prevented from axial movement into engagement with latch member 62 and movement of valve closure member 40 until the defined pressure event sequence defined by J-slot logic 50 has been completed. Pressure cycle independent indexer 12 may be utilized with various devices and methods for axially translating cycle mandrel 46 in response to an applied pressure as will be understood by those skilled in the art with benefit of this disclosure.

FIG. 3 is an expanded illustration of the pressure cycle independent indexer 12 section of downhole tool 30 depicted in FIG. 2. In this embodiment, sleeve 48 is rotationally disposed about cycle mandrel 46 and rotationally disposed within housing 60. J-slot logic 50 is formed (e.g., defined) in the outer surface 64 of cycle mandrel 46. In the depicted embodiment, J-slot pin 52 is disposed through sleeve 48 into engagement with J-slot logic 50 such that the axial translation of cycle mandrel 46 causes sleeve 48 to rotate as J-slot pin 52 moves along J-slot logic 50, as further described for example with reference to FIGS. 5-11. Upon completion of cycling through the defined pressure event sequence (e.g., trigger sequence path), cycle mandrel lugs 66 (i.e., protrusions) and sleeve lugs 68 (i.e., protrusions) are offset from one another permitting cycle mandrel 46 to move axially into operational contact with latch 62 when the applied pressure is bled-off.

Figure 4:
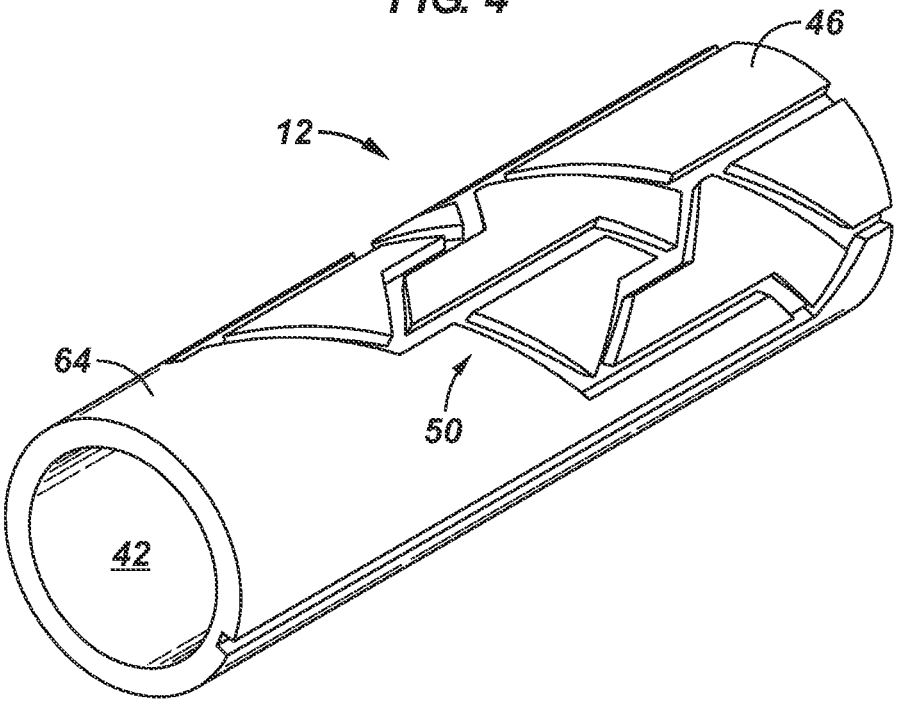
FIG. 4 illustrates an example of a cycle mandrel carrying J-slot logic in accordance with one or more embodiments of a pressure cycle independent indexer.

FIG. 4 illustrates an example of a J-slot logic 50 formed on outer surface 64 of a cycle mandrel 46 in accordance with one or more embodiments of pressure cycle independent indexer 12. J-slot logic 50 is an indexing pattern formed of one or more of slots, grooves, or elevations. In accordance to one or more embodiments, cycle mandrel 46 has an outside diameter of less than about one (1) inch (2.5 cm). In accordance to some embodiments, cycle mandrel 46 has an outside diameter greater than one inch. In some embodiments, J-slot logic 50 is formed in its entirety circumferentially along an outer surface 64 of a single cycle mandrel 46. In some embodiments, J-slot logic 50 may be formed, for example with reference to FIGS. 11-17, in sections 150, 250, 350, etc. axially spaced along a single cycle mandrel 46 or on multiple cycle mandrels 146, 246, 346, etc. that are aligned axially relative to one another.

Figure 5:
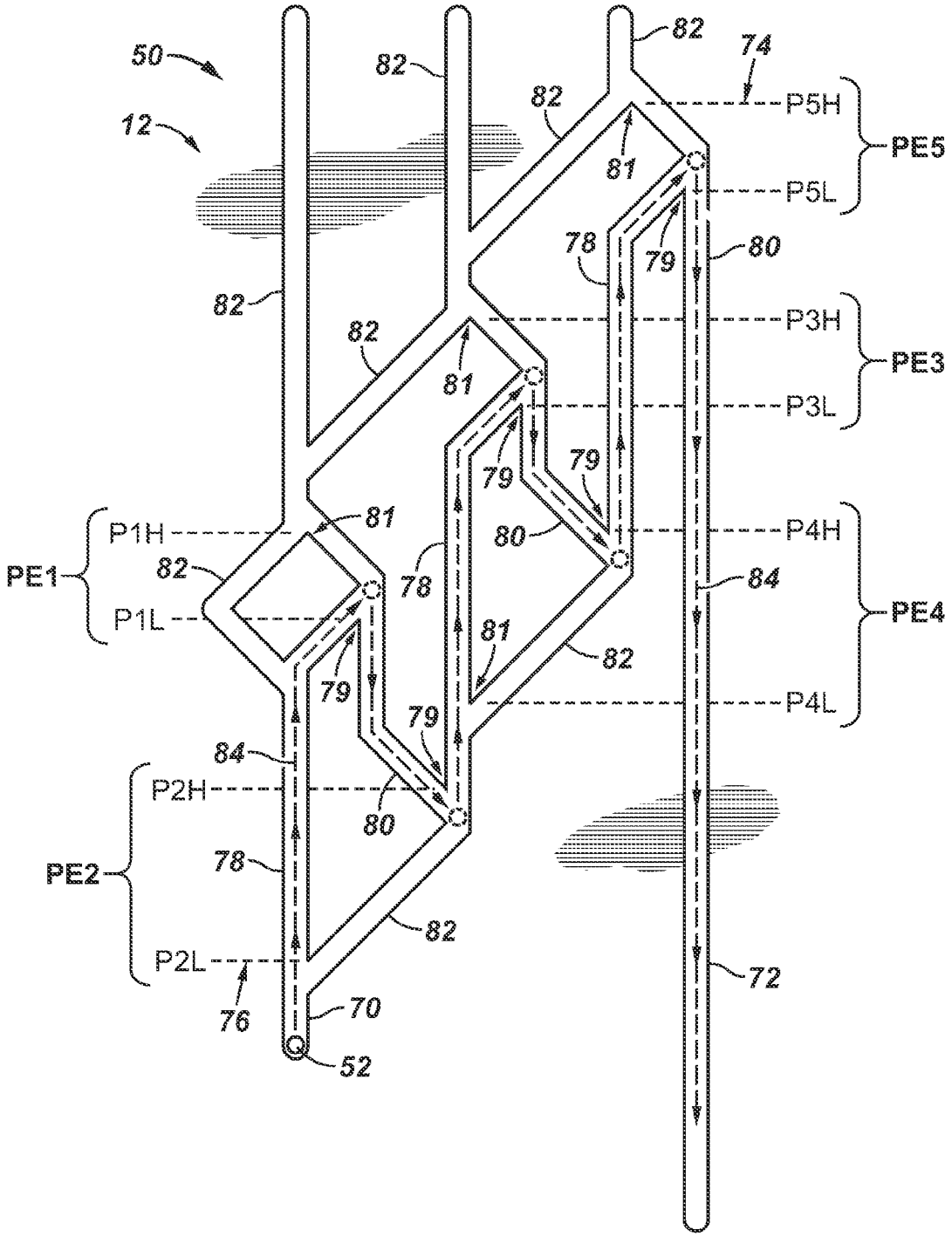
FIGS. 5-11 are flattened views of an example of J-slot logic in accordance with one or more embodiments of a pressure cycle independent indexer.
Figure 9:
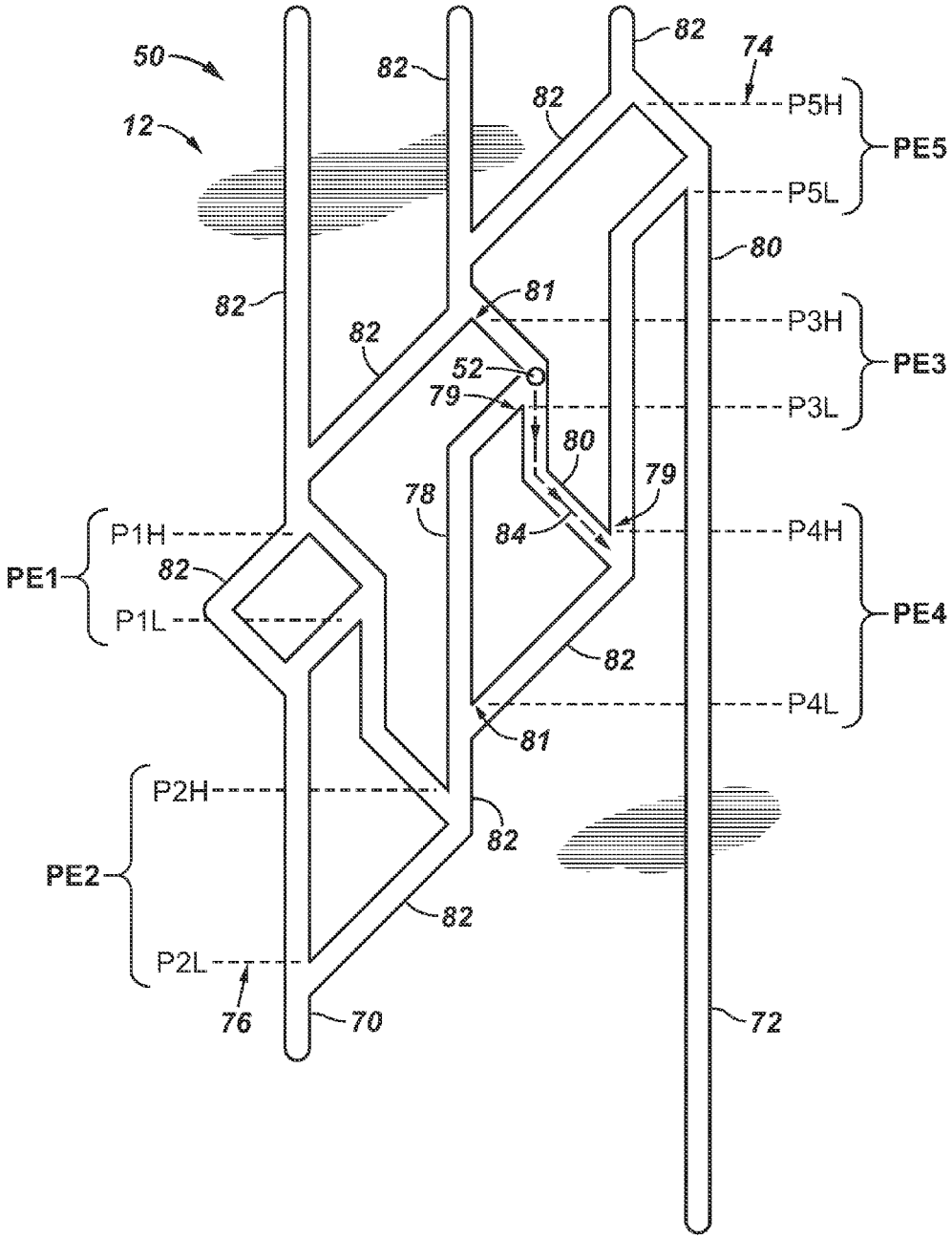
Figure 10:
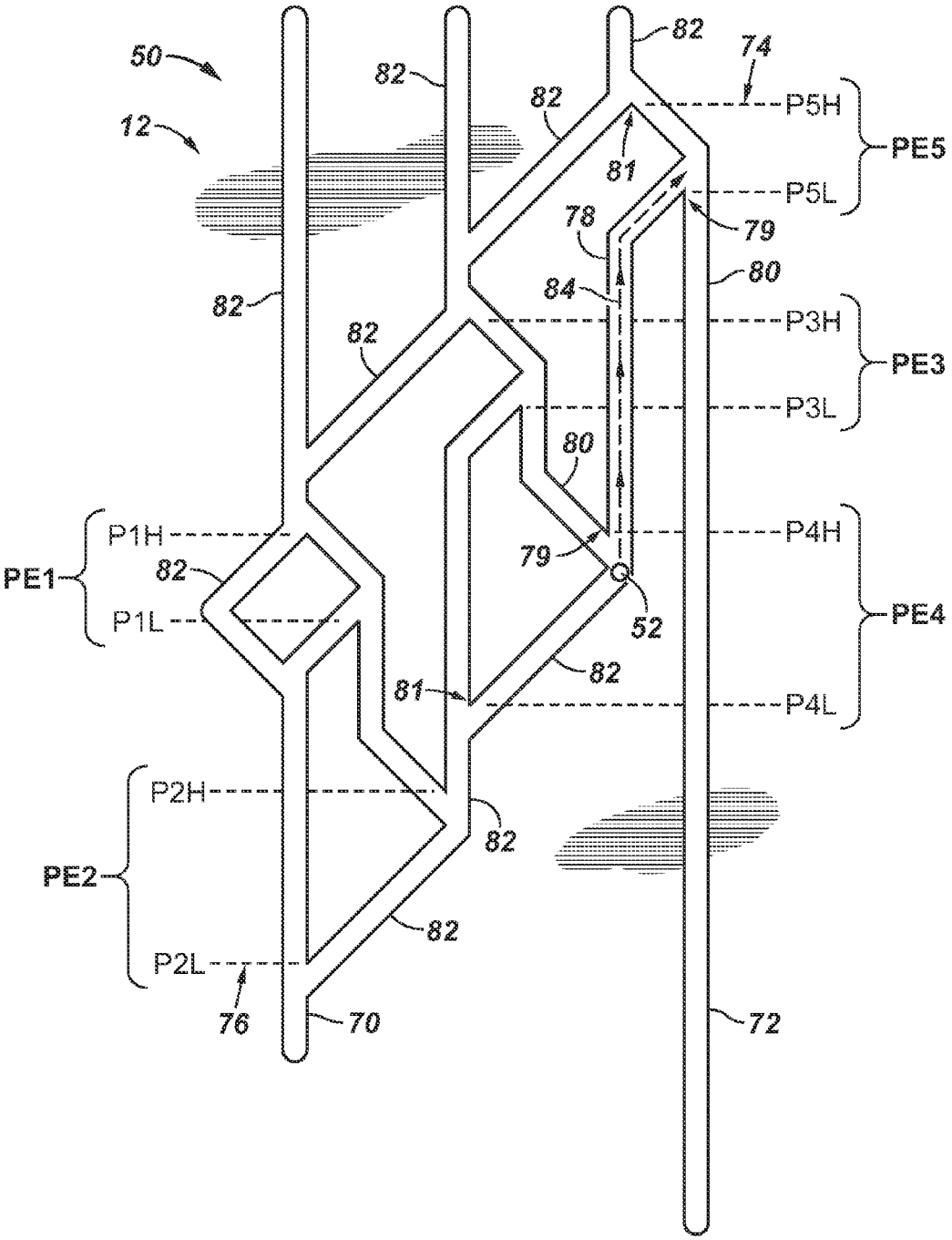
Figure 11:
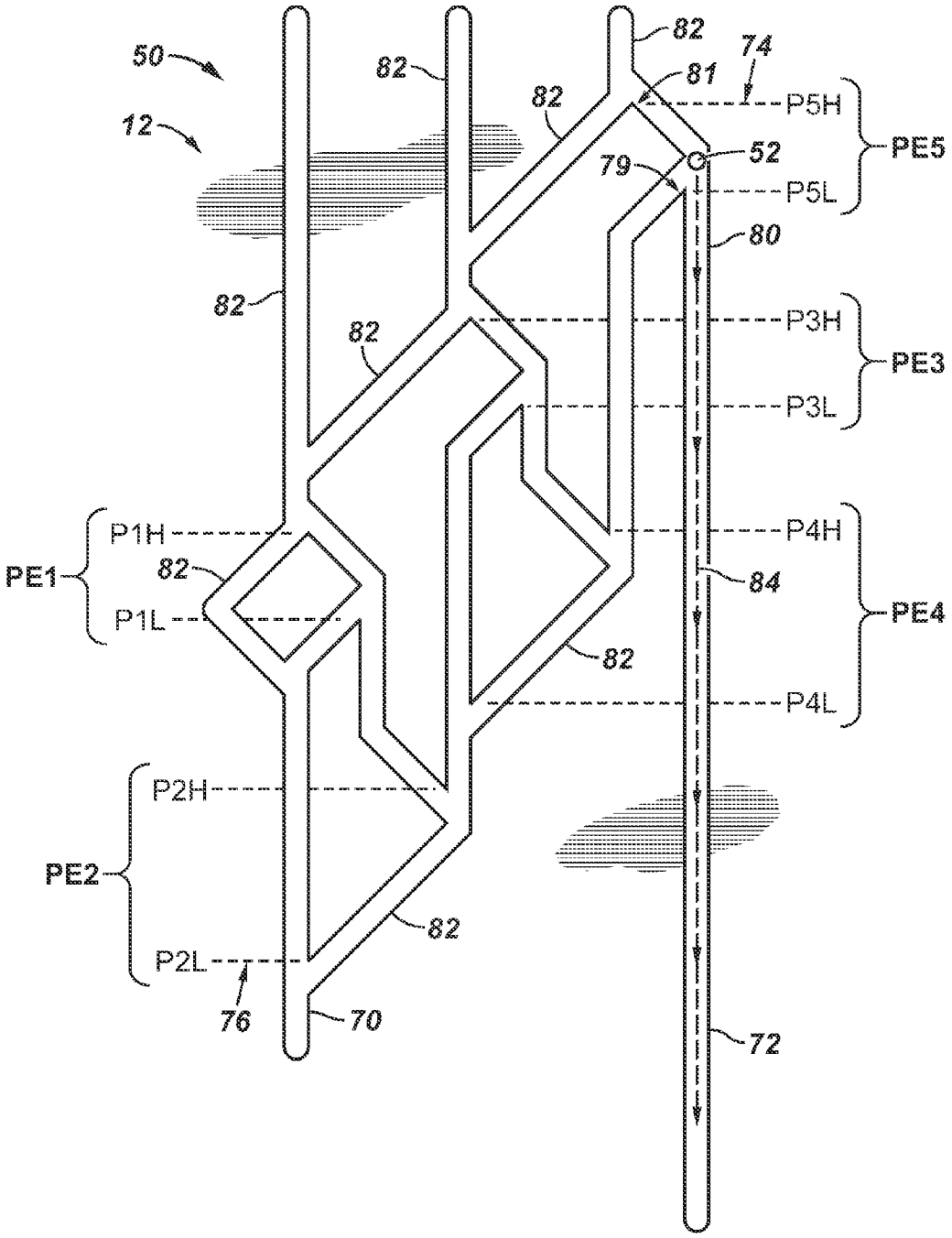

FIGS. 5-11 are flattened views of an example of J-slot logic 50 defining a sequence of pressure events PE in accordance with one or more embodiments of a pressure cycle independent indexer. J-slot logic 50 is embodied by the J-slot (e.g., slots, grooves, elevations) formed in a geometric pattern or track for example on a cycle mandrel. J-slot logic 50 has a trigger sequence path, generally denoted by the numeral 84 and the arrows in FIG. 5, that extends from a starting slot 70 and terminating at an actuation slot 72, also referred to from time to time as a long slot. Trigger sequence path 84 includes pressure up sequence legs 78 and bleed down sequence legs 80. J-slot pin 52 is illustrated in FIG. 5 disposed in starting slot 70. This position is also referred to as zero in the event count, also referred to from time to time as the cycle count. Trigger sequence path 84 defines a sequence of pressure events PE that must be achieved to cycle J-slot pin 52 from starting slot 70 across trigger sequence path 84 illustrated in FIG. 5 into actuation slot 72 as illustrated in FIG. 11 to actuate, for example the indexed formation valve 30 (FIGS. 2-3), from a first position to a second position. J-slot logic 50 includes return paths 82 leading from trigger sequence path 84 to a preceding position or point in on trigger sequence path 84, for example starting slot 70 in this embodiment.

The pressure event sequence, or signature, may contain any number of combinations of pressure events. The number of pressure events required for the pressure event sequence, or signature, to actuate the indexed downhole tool could be as little as one or as many as needed or desired. The more pressure events that are defined by trigger sequence path 84, the more unique the pressure event sequence and the signature of the indexed downhole tool.

In some embodiments J-slot logic 50 includes a high threshold value 74 (i.e., pressure value) and/or a low threshold value 76 (i.e., pressure value). If high threshold value 74 or low threshold value 76 is exceeded then the event count will be reset to zero with J-slot pin 52 located in starting slot 70 in the example illustrated in FIGS. 5-11. Accordingly, the event count can be reset to zero at any time prior to the final bleed down in actuation slot 72 of the pressure event sequence. For example, if the surface applied pressure system, e.g., hydraulic pump 34, can supply a maximum of 5,000 psi, the high threshold value can be set at 4,000 psi and the low threshold value can be set to 1,000 psi. Any applied pressure above 4,000 psi will index J-slot pin 52 into a return path 82 that will reset the event count to zero on bleed down. Also in this embodiment, any bleed down pressure below 1,000 psi will index J-slot pin 52 along a return path that will reset the event count to zero. A requirement to periodically apply or bleed the surface applied pressure to a specific value that exceeds at least one of high threshold value 74 or low threshold value 76 will reset the event count until it is desired to actuate the indexed downhole tool, at which time the pressure event sequence will be commenced. The ability to reset the event count, in particular reset the event count to zero, may eliminate the need for an operator to keep a record of the pressure cycles applied.

According to some embodiments, a pressure cycle independent indexer device 12 includes J-slot logic 50 (i.e., indexing pattern) and a pin 52 moveable along the indexing pattern in response to a pressure signal. The indexing pattern includes a trigger sequence path 84 defining one or more pressure events PE between a starting slot 70 and an actuation slot 72 and each pressure event being located between a sequence transition point 79 from an incoming sequence leg 78, 80 into an outgoing sequence leg 78, 80 and a return transition point 81 from the trigger sequence path 84 into a return path 82. In some embodiments, each of the pressure events is associated with a pressure range between a first pressure value associated with the sequence transition point and a second value associated for example with the return transition point. In accordance with an embodiment, the indexing pattern defines the return path to move the pin from the trigger sequence path to the starting slot in response to the pressure signal exceeding a high threshold pressure value and/or a low threshold pressure value.

With reference to FIG. 5, an example of a J-slot logic 50 comprising five pressure events, generally denoted by the callout "PE" and individually identified as PE1, PE2, PE3, PE4, PE5, etc. with respect to the position of the individual pressure event in the pressure event sequence. Accordingly, J-slot logic 50 depicted in FIGS. 5-11 has a trigger sequence path, generally denoted by the numeral 84, defining one or more pressure events PE in a sequence PE1-PE5 between starting slot 70 and terminating in actuation slot 72. Trigger sequence path 84 is depicted by the arrows.

Each pressure event PE is defined by a pressure range in FIGS. 5-11, for example first pressure event PE1 is defined between a high pressure value P1H and a low pressure value P1L. To achieve a pressure event, the applied pressure must terminate between high pressure value P1H and low pressure value P1L prior to the subsequent pressure up or bleed down signal sequence. For example, to index from pressure event PE1 to pressure event PE2, the applied pressure in the pressure up sequence must be greater than P1L and less than P1H prior to performing the bleed down sequence to index from pressure event PE1 to pressure event PE2. The depicted J-slot logic 50 also defines high threshold pressure value 74 and low threshold pressure value 76. J-slot logic 50 defines return paths 82 such that J-slot pin 52 is moved from trigger sequence path 84 into return path 82 when the applied signal, exceeds either of high threshold pressure value 74 and the low threshold pressure 76.

Each pressure value of a respective pressure event pressure range is associated with either a sequence transition point, generally denoted by the numeral 79, within J-slot logic 50 or a return transition point, generally denoted by the numeral 81, within J-slot logic 50. Sequence transition point 79 is a lip or wall portion of J-slot logic 50 formed by cycle mandrel 46, separating the incoming sequence leg from the outgoing sequence leg of trigger sequence path 84. For example, each pressure up sequence leg 78 is separated from the next bleed down sequence leg 80 by a sequence transition point 79. Return transition point 81 is a lip or wall portion of J-slot logic 50 formed by cycle mandrel 46, separating a sequence leg 78, 80 (i.e., trigger sequence path 84) from a return path 82 of J-slot logic 50.

An example of a method of operating an indexed downhole tool 30, such as an indexed formation isolation valve 30, in a well system 10 is now described with reference to FIGS. 1-11. According to embodiments, when indexed downhole tool 30 is disposed in the wellbore, hydraulic pressure signals can be cycled by increasing and decreasing the tubing pressure without actuating the downhole tool. The cycling of the pressure will move J-slot pin 52 along J-slot logic 50, however, J-slot pin 52 will not be cycled or shifted through trigger sequence path 84 to actuation slot 72 unless the trigger sequence 84 is achieved by the application of the signature pressure event signature.

In FIG. 5, J-slot pin 52 is disposed in starting slot 70 reflecting that the event count of trigger sequence path 84 is at zero. For example, after deploying downhole tool 30 in the well a hydraulic signal exceeding a threshold value 74, 76 may be applied to move J-slot pin 52 from a position on trigger sequence path 84 into return path 82 and back to starting slot 70. Initiating the signature sequence of pressure events PE defined by trigger sequence path 84, a surface pressure signal is applied, for example pressuring up tubing 32 and axially translating cycle mandrel 46 and indexing J-slot pin 52 along pressure up sequence leg 78, which is the incoming pressure sequence leg to pressure event PE1, as shown by the arrow in FIG. 5.

Figure 6:
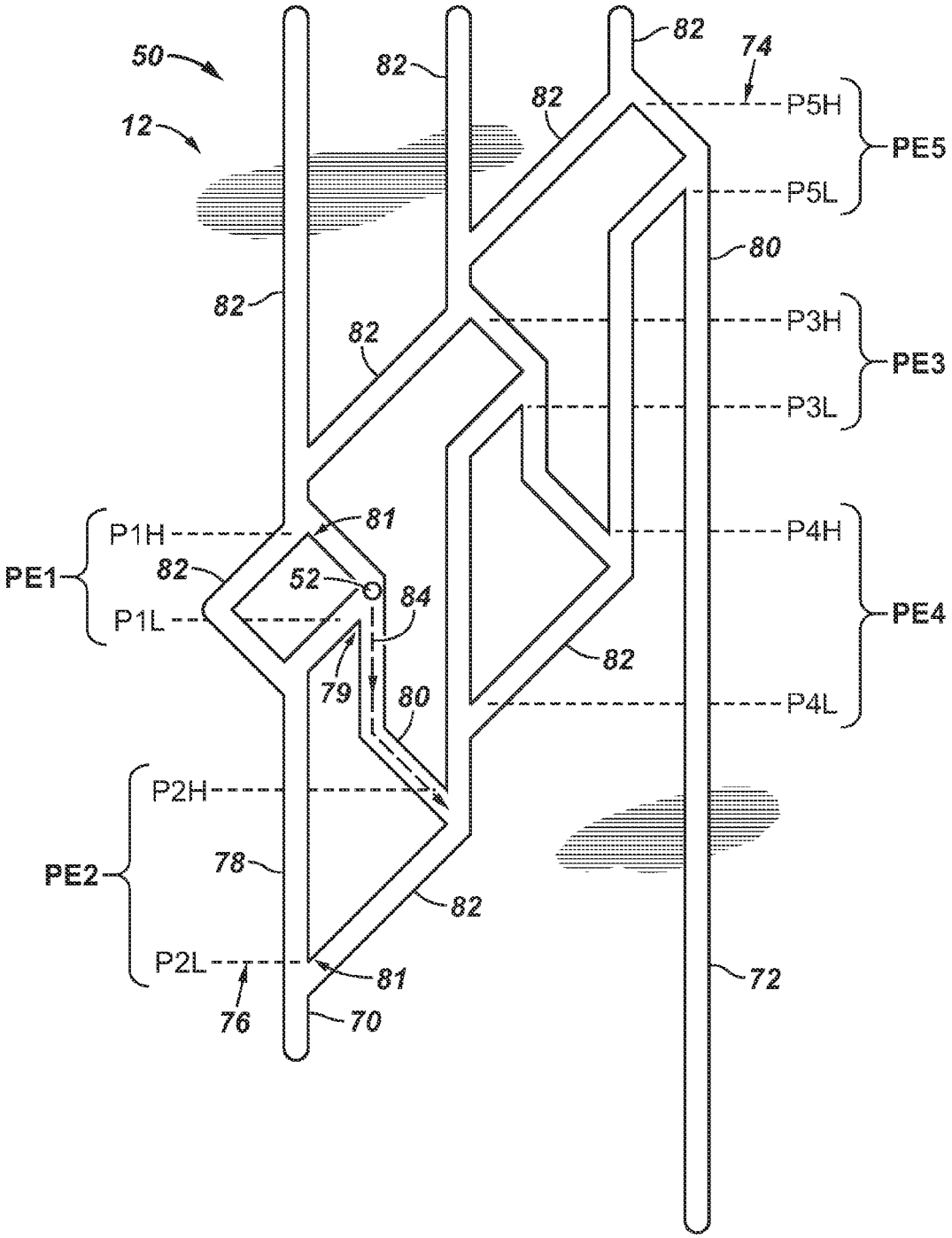

FIG. 6 illustrates the trigger sequence path of J-slot logic 50 after pressure event PE1 has been achieved, i.e., satisfied, and the event count is proceeding to pressure event PE2. J-slot pin 52 is illustrated in FIG. 6 located at pressure event PE1 between high pressure value P1H associated with return transition point 81 and P1L associated with sequence transition point 79. The incoming pressure signal is to a pressure value within pressure range P1L to P1H of pressure event PE1. Upon pressure bleed down, as shown by the arrow in FIG. 6, J-slot pin 52 is moved (e.g., directed) by sequence transition point 79 into bleed down sequence leg 80, which is the outgoing sequence leg relative to pressure event PE1 and the incoming sequence leg relative to pressure event PE2. With reference to individual pressure events, J-slot pin 52 moves towards the particular pressure event through an incoming sequence leg which may be either a pressure up sequence leg 78 or a bleed down sequence leg 80 and if the pressure event is achieved J-slot pin 52 moves into an outgoing sequence leg which is the other of a pressure up sequence leg 78 or a bleed down leg 80.

Figure 7:
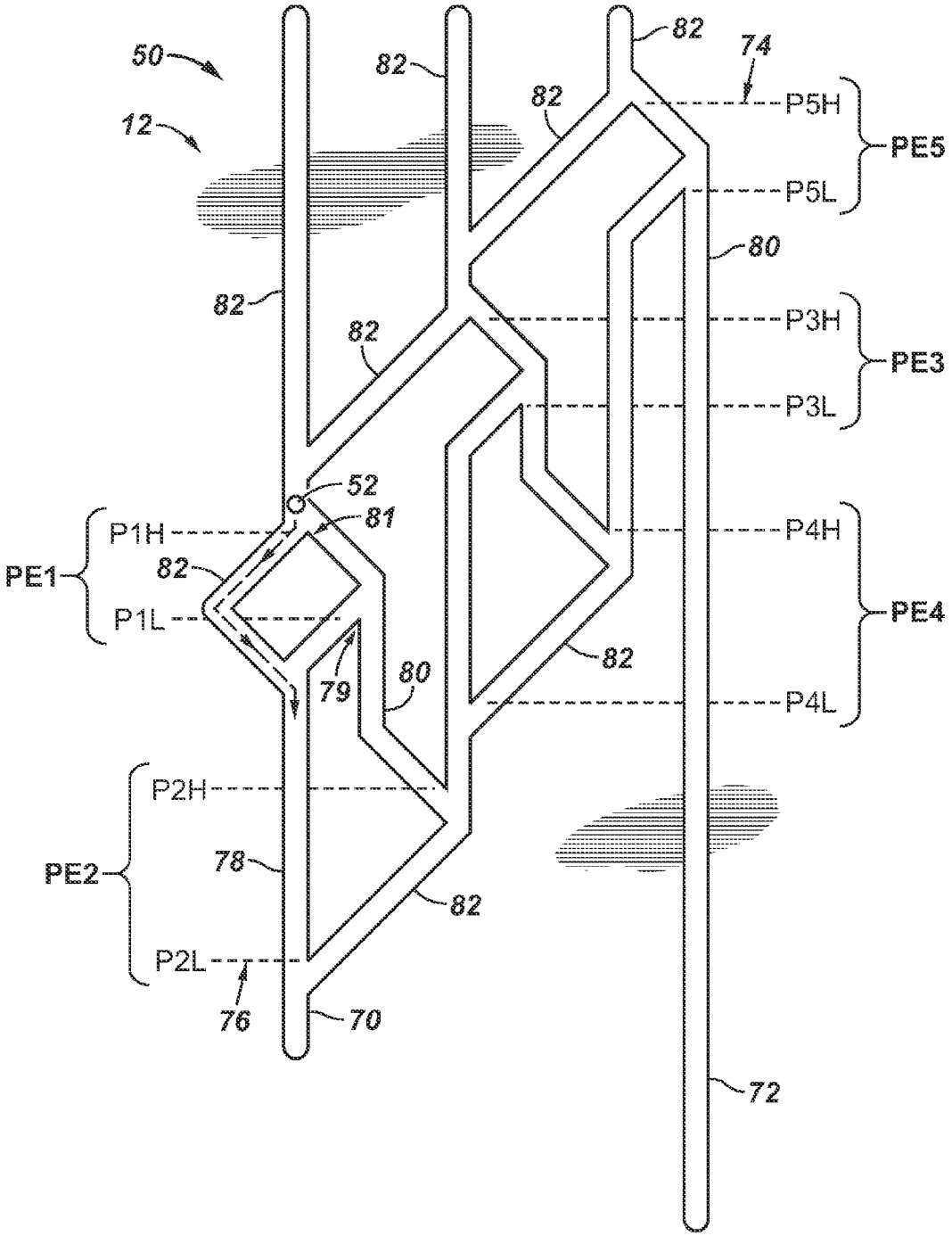

FIG. 7 illustrates an example of pressure event PE1 not being achieved and the trigger sequence event count being reset to zero. Referring back to FIGS. 5 and 6, if pressure up of tubing 32 continues to a value greater than high pressure value P1H, then J-slot pin 52 moves (i.e., indexes) past return transition point 81 of pressure event PE1 and J-slot pin 52 is moved into a return path 82 of J-slot logic 50. Upon the subsequent bleed down pressure signal, J-slot pin 52 will be directed by return transition point 81 along the return path 82 and into starting slot 70. The illustrated movement of J-slot pin 52 out of the trigger sequence path and into return path 82 may be in response to an inadvertent failure to achieve pressure event PE1 by cycling from pressure up to bleed down within pressure range P1L to P1H or by intentionally pressuring up above the pressure value of P1H or of high pressure threshold value 74 to reset the event count to zero.

Figure 8:
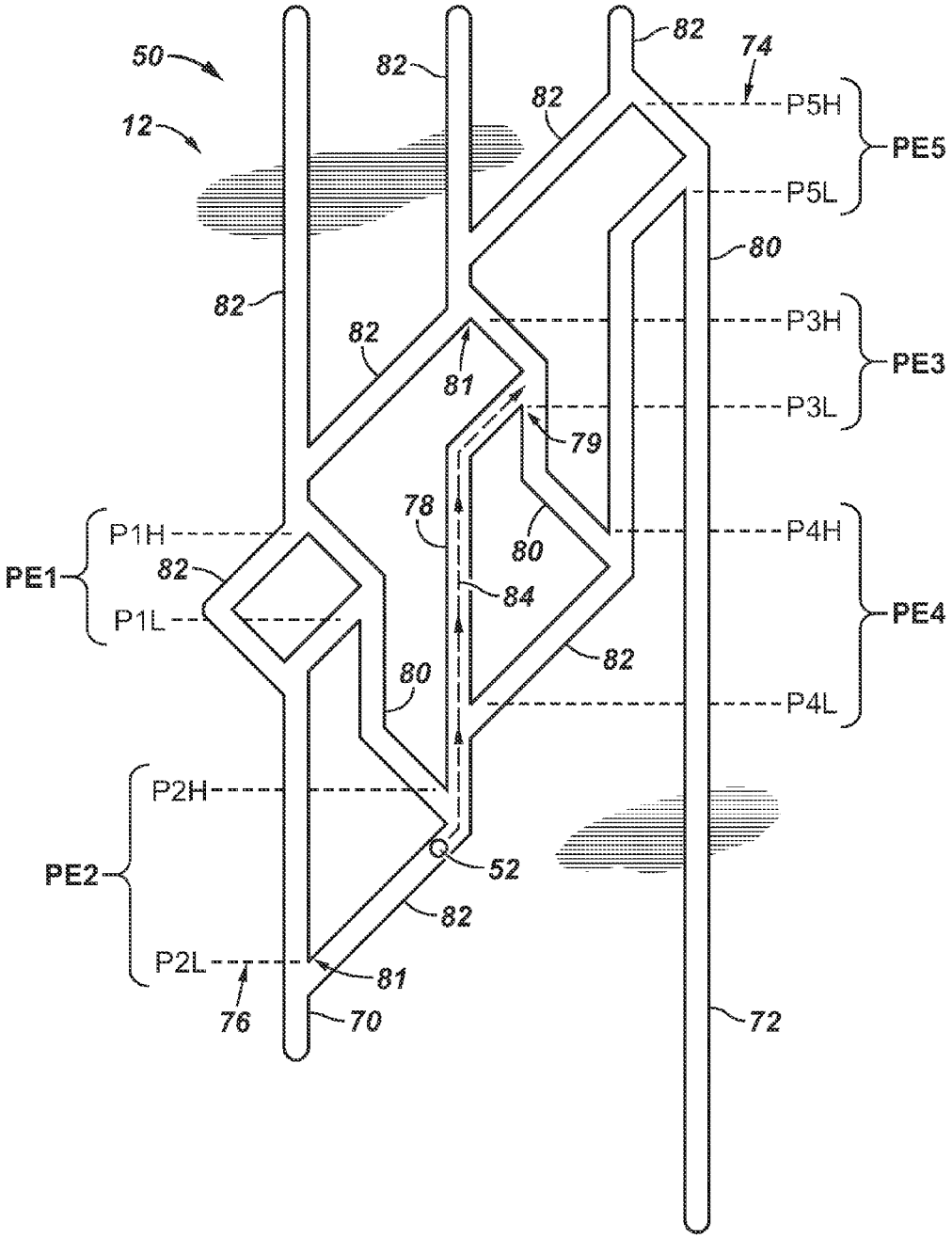

FIG. 8 illustrates J-slot pin 52 located within pressure event PE2 portion of the trigger sequence path of J-slot logic 50. The incoming bleed down tubing pressure signal from pressure event PE1 is terminated at a value between P2L and P2H and a subsequent pressure up signal commences moving J-slot pin 52 along pressure up sequence leg 78 toward pressure event PE3 as illustrated by the arrow in FIG. 8. If low pressure value P2L is exceeded in the bleed down sequence from pressure event PE1 into the second pressure event PE2 then J-slot pin 52 will move past return transition 81 and will be located at starting slot 70 in this embodiment and the event count will be reset to zero.

FIG. 9 illustrates J-slot pin 52 located in the third pressure event PE3 in the pressure event sequence defined by trigger sequence path 84 (FIG. 5). If high pressure value P3H is exceeded in the pressure up sequence incoming from pressure event PE2, then J-slot pin 52 will travel into a return path 82 of J-slot logic 50 and upon the subsequent bleed down the event count will be reset to zero as J-slot pin 52 will be moved to starting slot 70. In the illustrated example, pressure event PE3 is achieved and J-slot pin 52 outgoing and moving along a bleed down leg 80 toward pressure event PE4 as tubing 32 pressure is bled-down from a value between high pressure value P3H and low pressure value P3L.

FIG. 10 illustrates pressure event PE4 achieved and J-slot pin 52 advancing as shown by the arrow in response to a pressure up signal along pressure up sequence leg 78 into pressure event PE5 of the trigger sequence path of J-slot logic 50. FIG. 11 illustrates J-slot pin located in pressure event PE5 and at actuation slot 72 in the depicted embodiment. On the bleed down pressure signal from pressure event PE5 J-slot pin 52 travels actuation slot 72 which is known as the long slot. At actuation slot 72, J-slot pin 52 is permitted to travel farther axially than previously permitted by J-slot logic 50 permitting the tool member, for example valve closure member 40 (FIG. 2) to be actuated from a first position to a second position.

With reference to FIGS. 1-11, an example of a pressure cycle independent method 12 of operating an indexed downhole valve 30 positioned in a wellbore 18 having a tubing 32 includes cycling hydraulic pressure signals in the tubing by increasing the tubing pressure and decreasing the tubing pressure; moving a pin 52 along an indexer pattern 50 operationally coupled with the downhole valve in response to cycling the hydraulic pressure signal, wherein the indexer pattern includes a trigger sequence path 84 extending from a starting slot 70 and an actuation slot 72 and defining a pressure event PE between a sequence transition point 79 from an incoming sequence leg 78, 80 and an outgoing sequence leg 78, 80 and a return transition point 81 into a return path 82; indexing the pin through the trigger sequence path into the actuation slot; and operating the downhole from a first position to a second position in response to the pin being indexed into the actuation slot.

Figure 12:
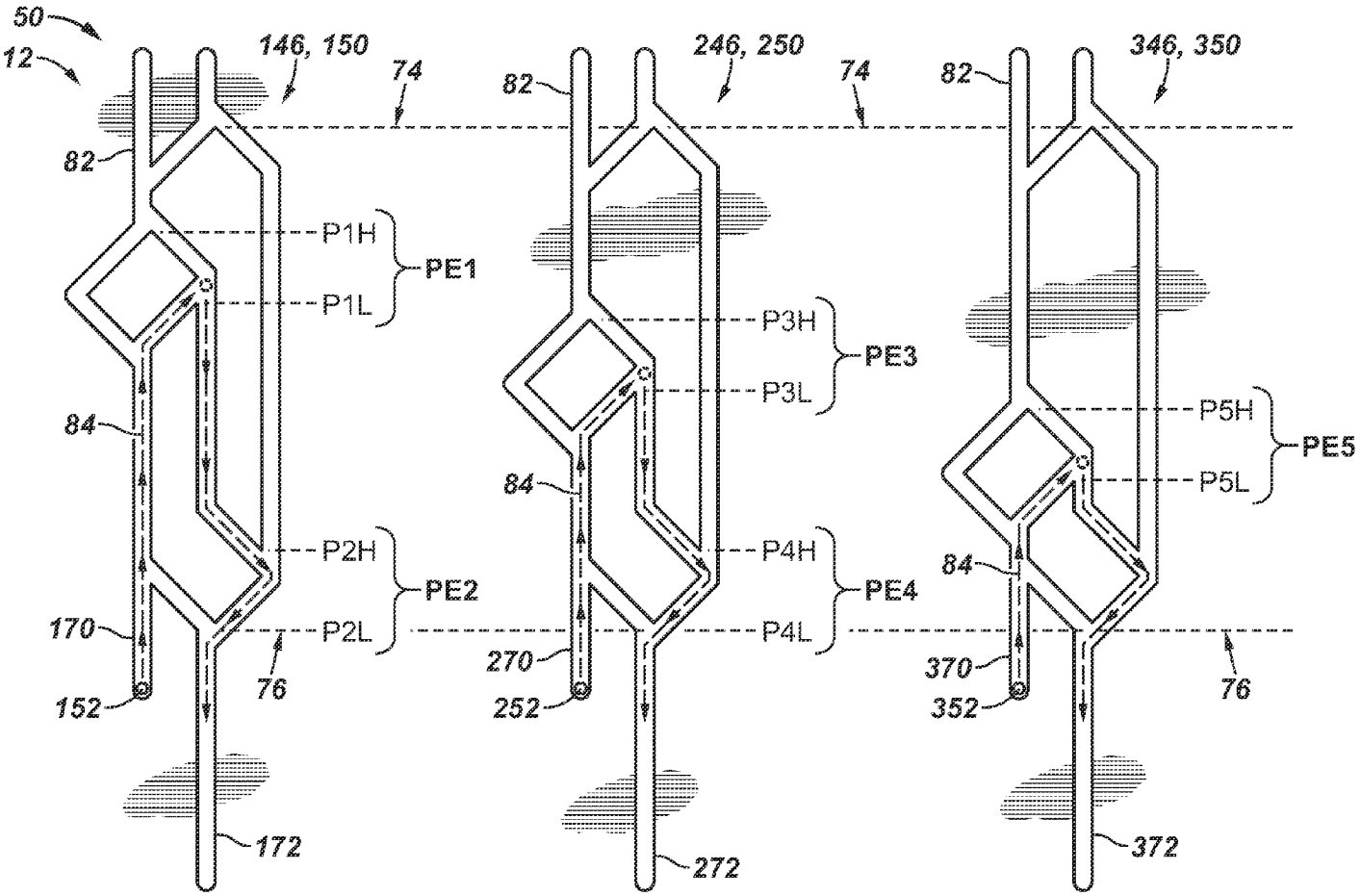
FIGS. 12-17 are flattened views of an example of J-slot logic formed on multiple cycle mandrels in accordance with one or more embodiments of a pressure cycle independent indexer.

Referring now to FIG. 12, a flattened view of an example of J-slot logic 50 formed in multiple sections according to one or more embodiments is illustrated. In the depicted example, J-slot logic 50 comprises logic sections 150, 250, 350 carried respectively by three cycle mandrels 146, 246, 346, or cycle mandrel sections. With further reference to FIGS. 1-3, logic sections 150, 250, 350 may be axially positioned relative to one another. Each logic section 150, 250, 350 is coupled with a respective J-slot pin 152, 252, 352. J-slot logic 50 defines a trigger sequence path 84 that extends from a starting slot 170, 270, 370 of the respective logic sections, or sequences, to the respective actuation slots 172, 272, 372. Trigger sequence path 84 defines a sequence of pressure events, generally denoted by the callout "PE," that must be achieved to cycle the respective J-slot pins 152, 252, 352 across trigger sequence path 84. In accordance with some embodiments, the multiple J-slot pins are cycled through trigger sequence path 84 in unison in the same manner described with reference to FIGS. 5-11 for cycling a single J-slot pin 52 through trigger sequence path 84.

Figure 13:
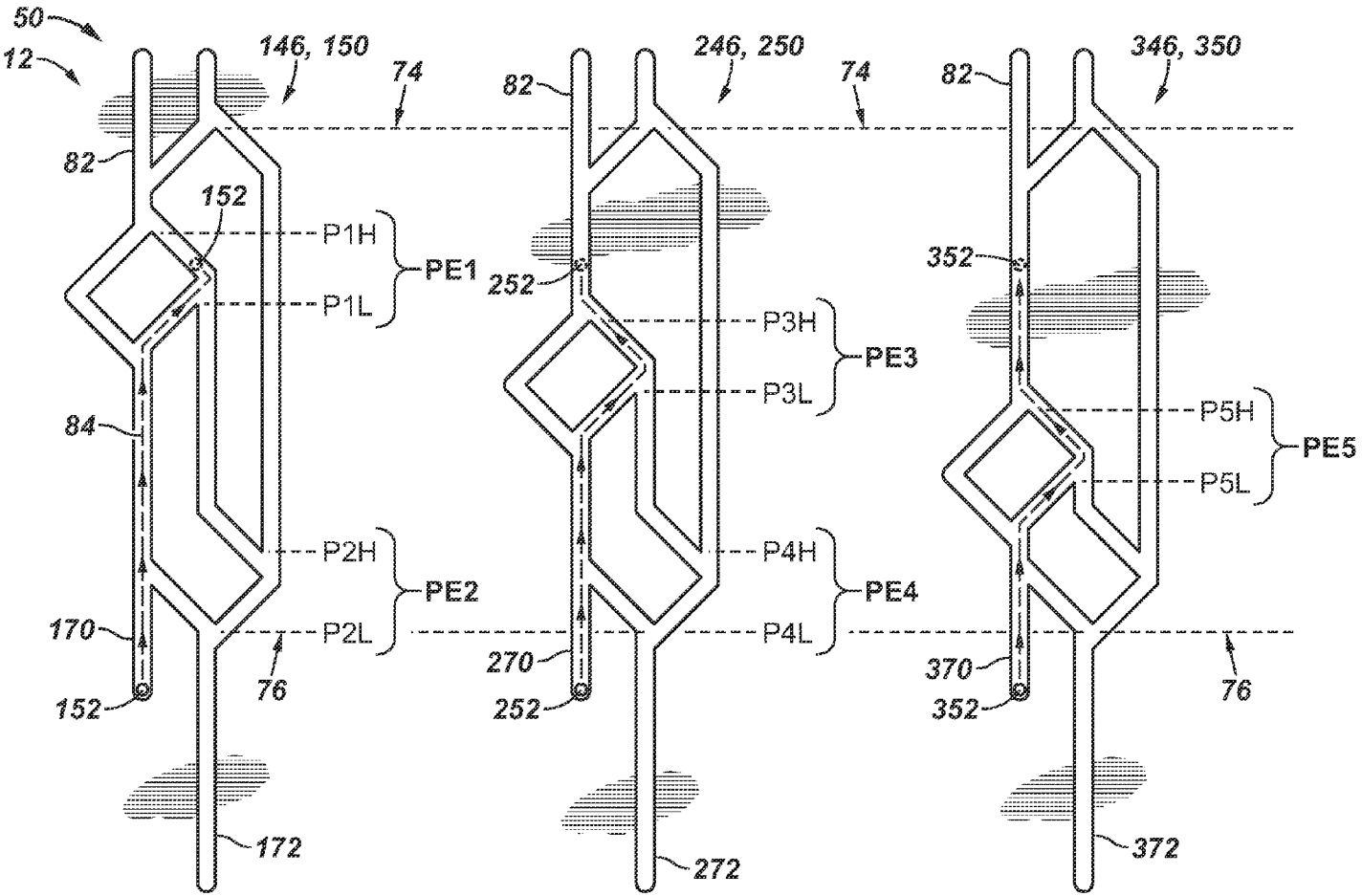
Figure 14:
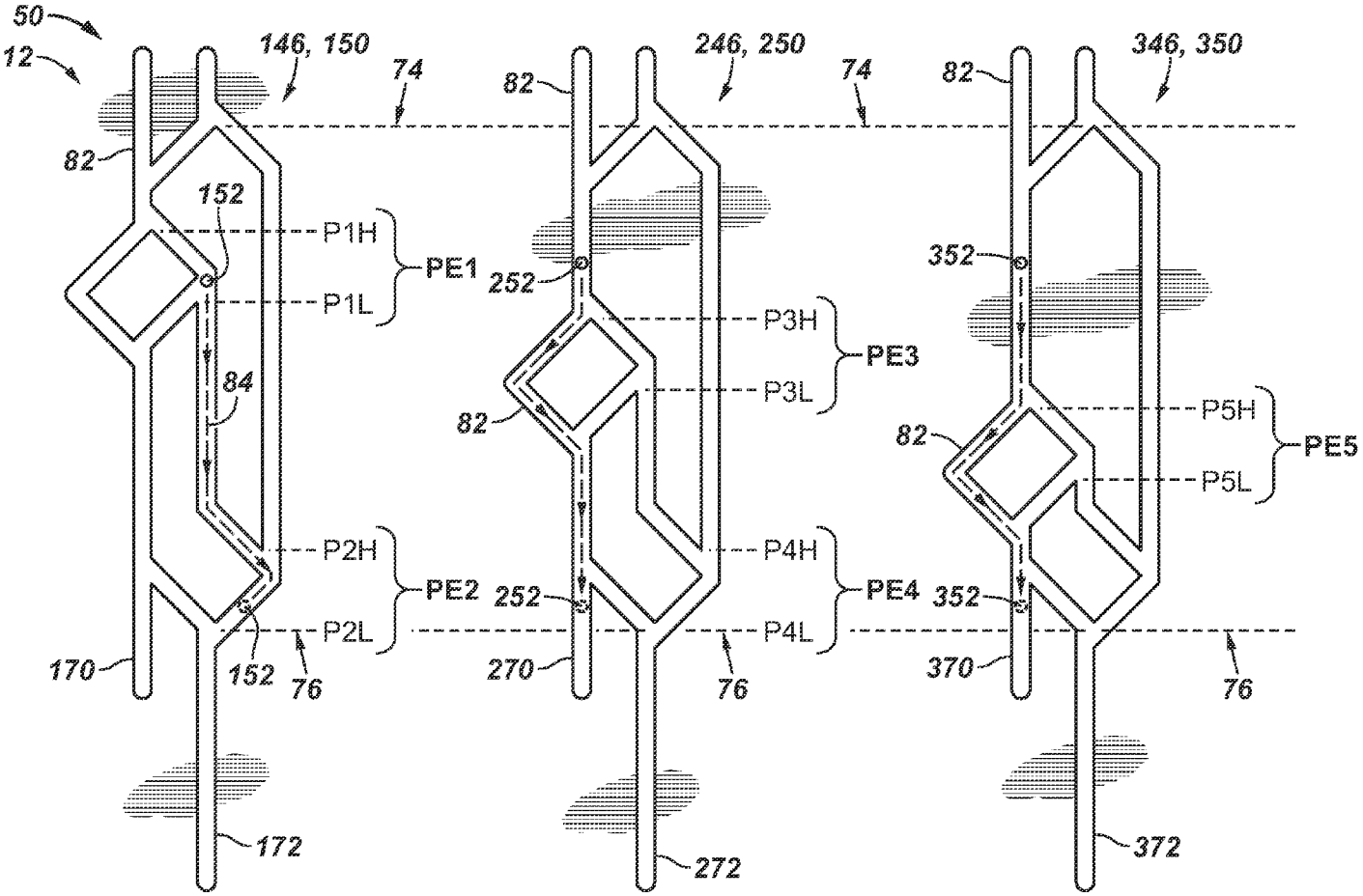

A method of operating a downhole tool 30 in accordance with one or more embodiments of pressure cycle independent indexer 12 is now described with reference to FIGS. 1-4 and 12-17. FIGS. 13 and 14 illustrate cycling through the first pressure event PE1. The cycle count for J-slot logic 50 and trigger sequence 84 is at zero with J-slot pins 152, 252, 352 located in the respective starting slots 170, 270, 370. In FIG. 13, tubing 32 pressure is applied corresponding to the pressure range P1L to P1H of first pressure event PE1 moving J-slot pin 152 into first pressure event PE1 section of trigger sequence path 84 and moving J-slot pins 252, 352 into return paths 82 of the respective logic sections 250, 350. Upon pressure bleed down as illustrated in FIG. 14, tubing 32 pressure is reduced from the pressure range P1L to P1H to the low pressure range of pressure event PE2. In the bleed down, J-slot pin 152 moves along trigger sequence path 84 from pressure event PE1 to pressure event PE2 and J-slot triggers 252, 253 move along return paths 82 to the respective starting slots 270, 370.

Figure 15:
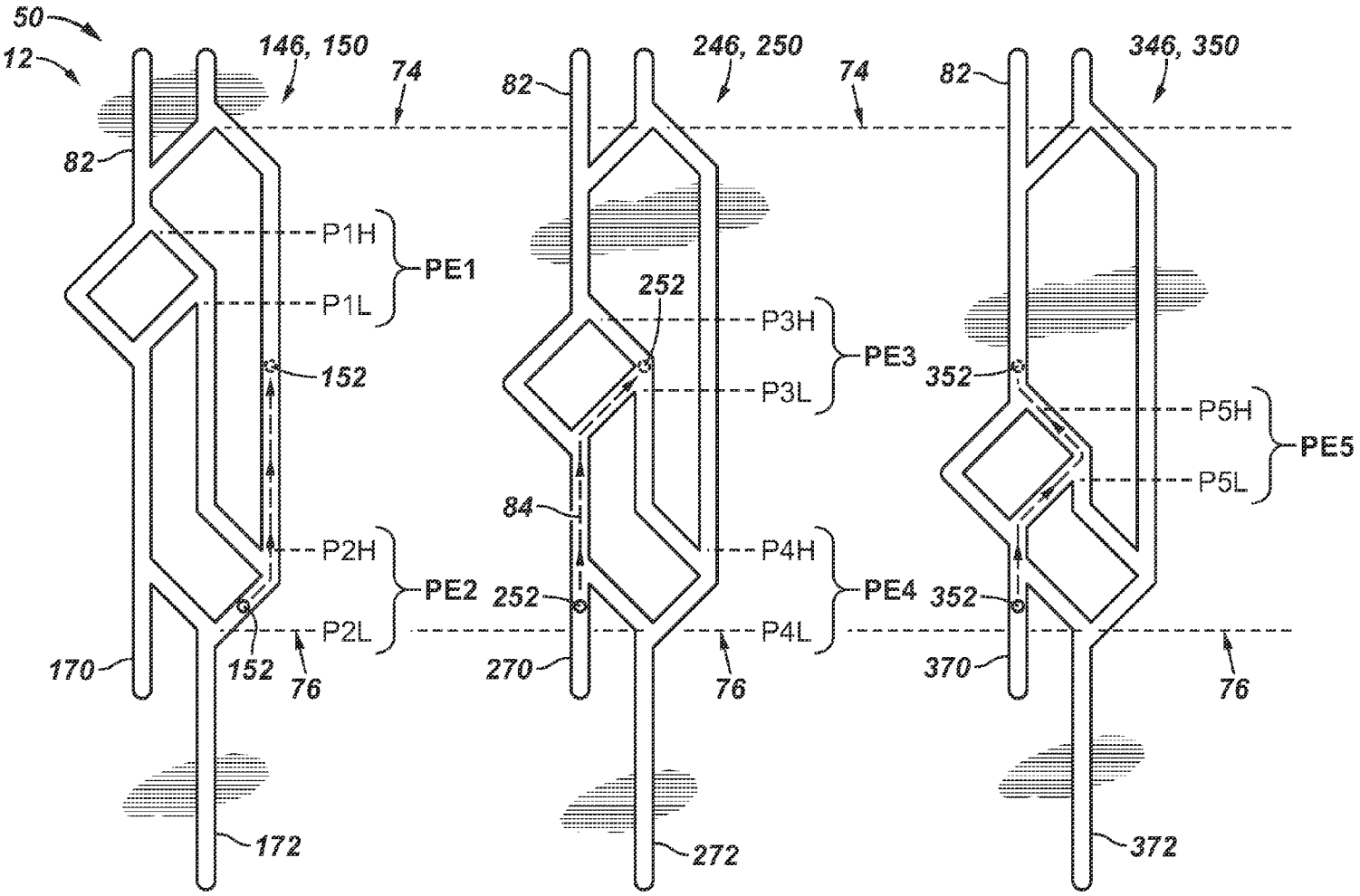

Referring to FIG. 15, pressure cycle independent indexer 12 is illustrated being cycled from pressure event PE2 to pressure event PE3. Tubing 32 pressure is increased to the pressure range of pressure event PE3 moving J-slot pin 252 into pressure event PE3 section of trigger sequence path 84 defined in logic section 250. J-slot pin 352 moves through pressure event PE5 of logic section 350 and into a return path 82. From the position illustrated in FIG. 15, tubing 32 pressure is reduced to pressure event PE4 thereby achieving, i.e., cycling through, pressure event PE3. In the same manner as described with FIGS. 5-11, if the applied hydraulic signal pressure exceeds high threshold pressure value 74 then the J-slot pins 152, 252, 352 will be cycled into returned paths 82 and moved to starting slots 170, 270, 370 upon the subsequent pressure bleed down.

Figure 16:
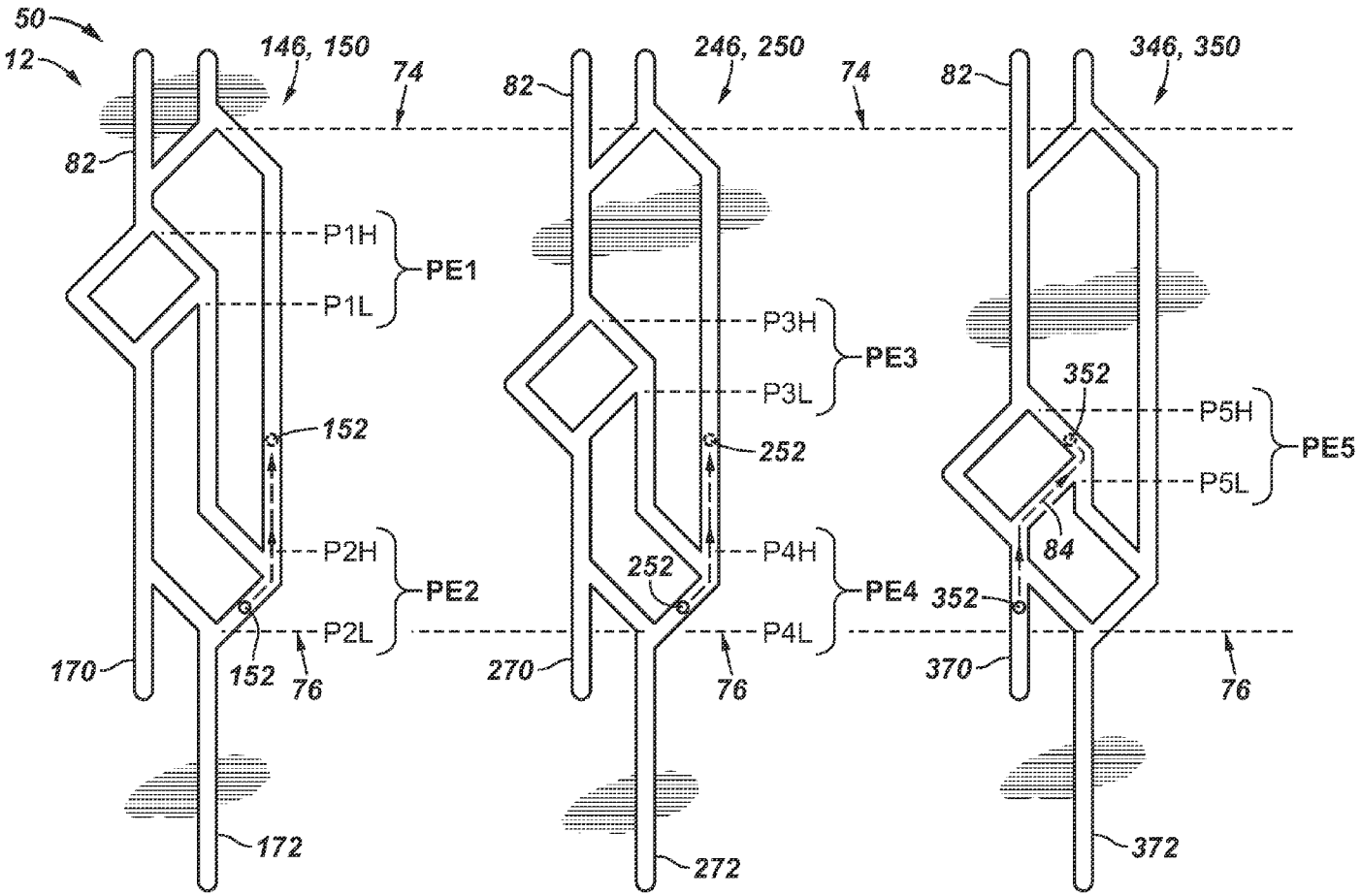
Figure 17:
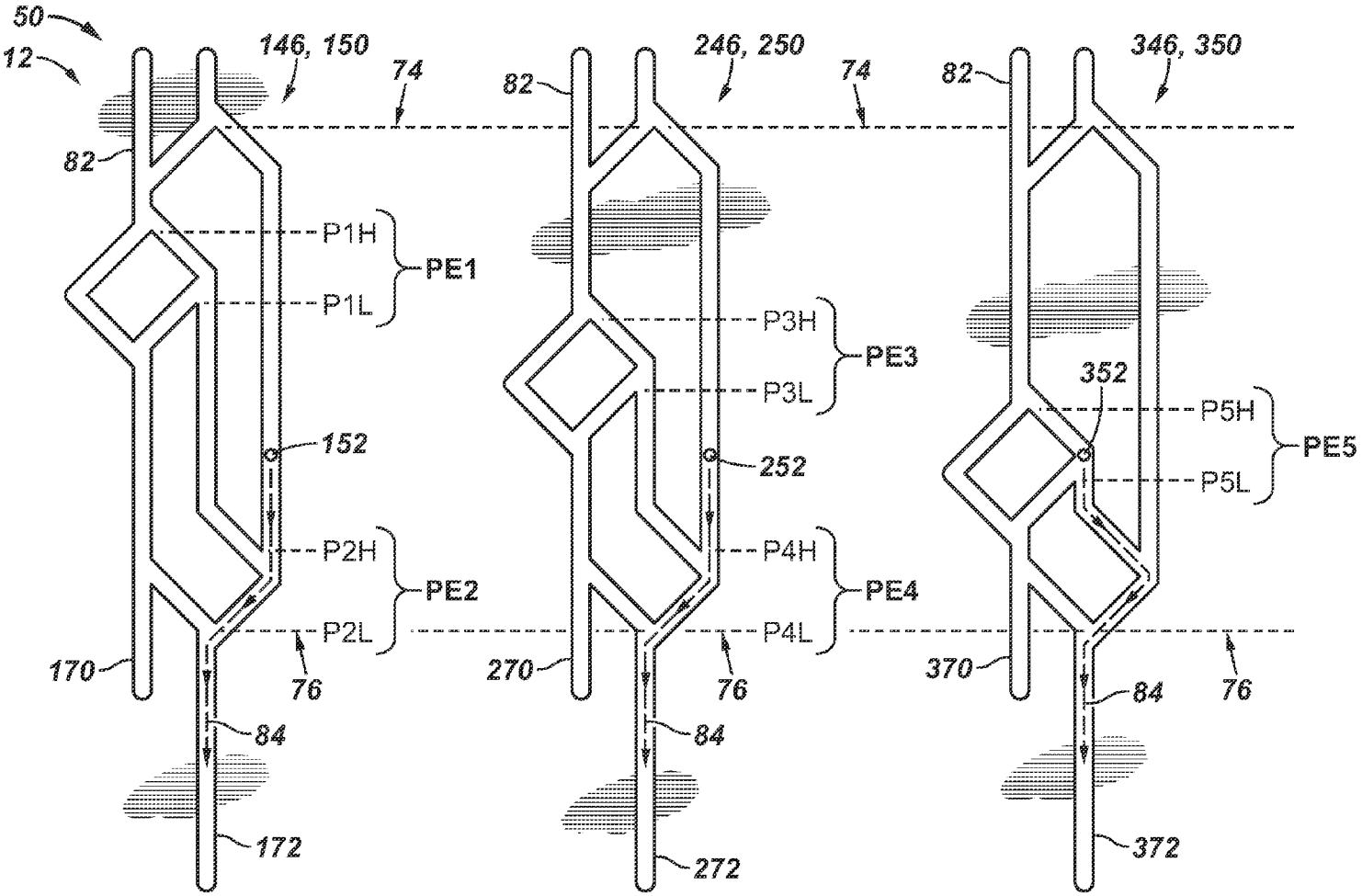

Referring to FIG. 16, pressure cycle independent indexer 12 is illustrated being cycled from pressure event PE4 to pressure event PE5 as tubing 32 pressure is increased from between P4L and P4H to within the pressure range of pressure event PE5. FIG. 17 illustrates the bleed down of tubing 32 pressure from pressure event PE5 moving each of J-slot pins 152, 252, 352 into the respective actuation slots 172, 272, 372 thereby actuating downhole tool 30 from one position to the next position. For example, the cycle mandrels may move in unison in the manner of single cycle mandrel 46 illustrated in FIG. 3. In accordance with some embodiments, movement of a J-slot pin into a return path 82 may reset the sequence or event count to a preceding position but not necessarily to zero. For example in the depicted embodiment, after completion of the pressure events defined on logic section 150, failure to achieve the subsequent pressure events will not reset the event count to zero unless the high pressure threshold 74 is exceeded. For example, if pressure event PE3 is not achieved, then J-slot pin 252 will return on bleed down to starting slot 270 thereby resetting the cycle count after pressure event PE2. Accordingly, pressure cycles may be applied in the well without necessarily cycling through the trigger sequence path and inadvertently actuating the indexed downhole tool.

Figure 18:
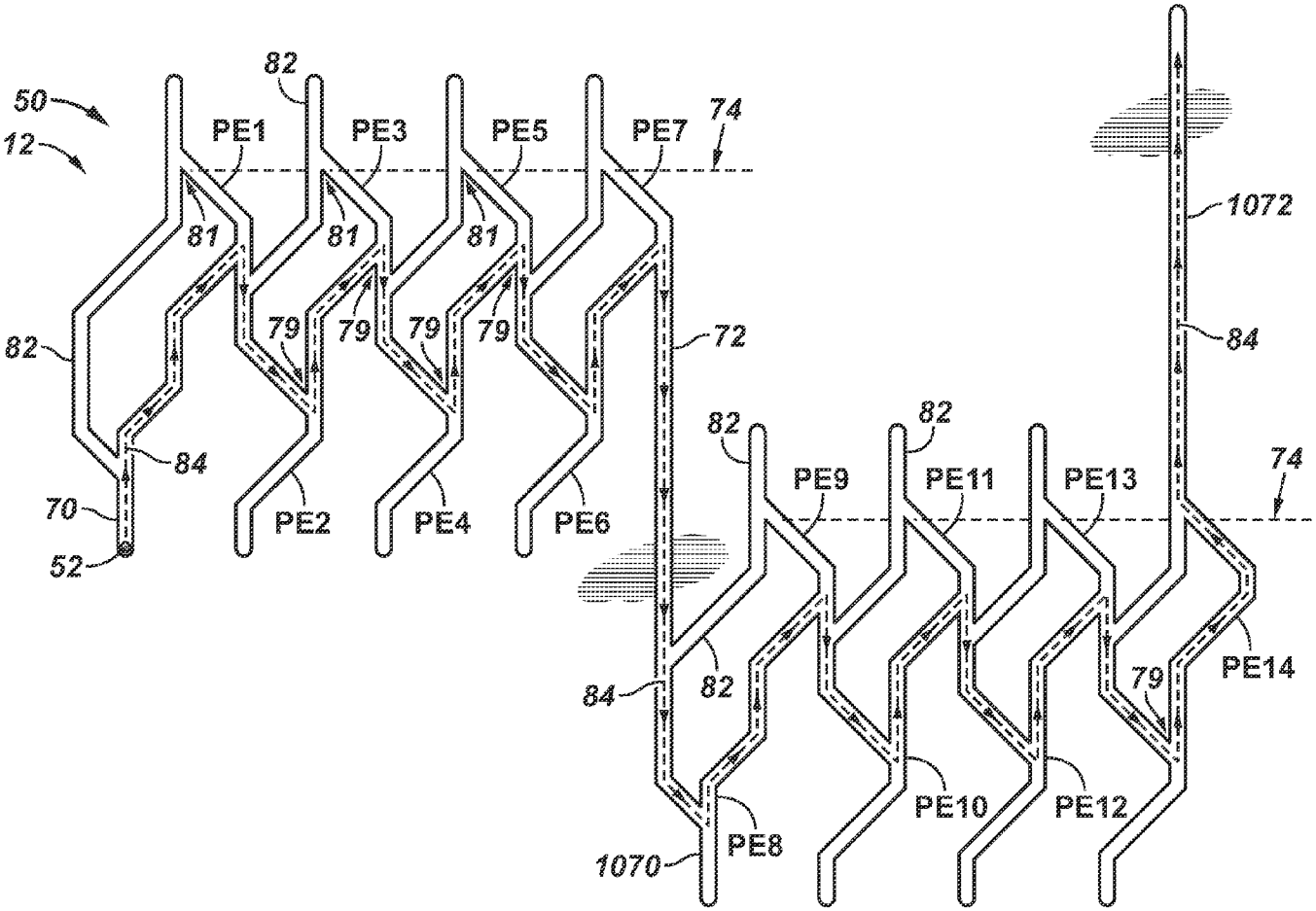
FIG. 18 illustrates a flattened view of an example of J-slot logic in accordance with one or more embodiments of a pressure cycle independent indexer.

FIG. 18 illustrates a flattened view of a J-slot logic defining a trigger sequence path 84 for actuating a device from a first position to a second position and from the second position to a third position. For example, J-slot logic 50 may define a trigger sequence path 84 to actuate an indexed downhole tool 30, such as a valve, from an open position to a close position and back to an open position. Trigger sequence path 84 is generally depicted by the arrows travelling from starting slot 70 through pressure events PE1 to PE7 and into the first actuation slot 72. Tubing pressure 32 is bled down from pressure event PE7 through actuation slot 72 to a pressure value within the pressure range of pressure event PE8 in the depicted embodiment. During the actuation bleed down, J-slot pin 52 moves through actuation slot 72 to a next starting slot 1070. Movement of J-slot pin 52 through actuation slot 72 corresponds to movement for example of cycle mandrel 46 and operator mandrel 54 (FIG. 3) to actuate the tool member, for example valve closure member 40, from a first position to a second position. Tubing 32 pressure can then be cycled up and down to move J-slot pin 52 from starting slot 1070 through pressure events PE9 to PE14 and in this embodiment pressure up through pressure event PE14 and threshold pressure value 74 along actuation slot 1072 to actuate downhole tool 30 from the second position to another position, for example back to the first position. The depicted J-slot logic 50 defines a high pressure threshold value 74 to facilitate movement of J-slot pin 52 out of trigger sequence path into a return path 82. In some embodiments, return path 82 moves the J-slot pin 52 to a preceding position without advancing the trigger sequence event count. Return path 82 may facilitate extending the number of pressure cycles applied in a well without inadvertently actuating the indexed downhole tool.

The foregoing outlines features of several embodiments of pressure cycle independent indexers, methods, tools and systems so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A pressure cycle independent indexer device, comprising an indexing pattern and a pin movable along the indexing pattern in response to a pressure signal, the indexing pattern having a trigger sequence path defining a plurality of pressure events along a plurality of pressure up sequence legs and a plurality of bleed down sequence legs between a starting slot and an actuation slot, wherein each pressure event is defined between a sequence transition point from an incoming pressure up sequence leg into an outgoing bleed down sequence leg and a return transition point from the trigger sequence path into a return path, the indexing pattern having a logic including a high threshold value such that applying a pressure which exceeds the high threshold value, at any point along the trigger sequence path, forces a transition to the return path and a restart at the starting slot.

2. The device of claim 1, wherein the indexing pattern defines the return path to move the pin from the trigger sequence path to the starting slot in response to exceeding a low threshold pressure value.

3. The device of claim 1, wherein:

the indexing pattern comprises a first indexing pattern section and a second indexing pattern section; and the pin comprises a first pin movable along the first indexing pattern section and a second pin movable along the second indexing pattern section.

4. The device of claim 1, wherein the sequence transition point is associated with a first pressure value and the return transition point is associated with a second pressure value.

5. A downhole tool, comprising:

a tool member operable from a first position to a second position;

a mandrel operably coupled to the tool member, the mandrel axially movable in response to a pressure signal comprising an increasing pressure signal and a decreasing pressure signal; and an indexer device coupled with the mandrel, including a pin movable in response to the pressure signal along an indexing pattern that permits movement of the mandrel to operate the tool member to the second position when the pin is positioned in an actuation slot, the indexing pattern comprising:

a trigger sequence path defining a plurality of pressure events along a plurality of pressure up sequence paths and a plurality of bleed down sequence paths between a starting slot and the actuation slot, the pressure event being defined between a sequence transition point from an incoming pressure up sequence path to an outgoing bleed down sequence path and a return transition point into a return path, the indexing pattern having a logic including a high threshold value such that applying a pressure which exceeds the high threshold value, at any location along the trigger sequence path, forces a transition to the return path and a restart at the starting slot.

6. The downhole tool of claim 5, wherein the indexing pattern defines the return path to move the pin from the trigger sequence path to the starting slot in response to the pressure signal exceeding a low threshold pressure value.

7. The downhole tool of claim 5, wherein:

the indexing pattern comprises a first indexing pattern section and a second indexing pattern section; and the pin comprises a first pin movable along the first indexing pattern section and a second pin movable along the second indexing pattern section.

8. The downhole tool of claim 5, wherein the tool member is a valve closure member of a formation isolation tool operable from an open position to a closed.

9. The downhole tool of claim 8, wherein:

the indexing pattern comprises a first indexing pattern section and a second indexing pattern section; and the pin comprises a first pin movable along the first indexing pattern section and a second pin movable along the second indexing pattern section.

10. A method of operating a downhole valve positioned in a wellbore having a tubing, comprising:

cycling hydraulic pressure signals in the tubing by increasing the tubing pressure and decreasing the tubing pressure;

moving a pin along an indexer pattern operationally coupled with the downhole valve in response to cycling the hydraulic pressure signal, the indexer pattern comprising a trigger sequence path extending from a starting slot to an actuation slot and defining a plurality of pressure events along a plurality of pressure up sequence legs and a plurality of bleed down sequence legs between a starting slot and an actuation slot, wherein each pressure event is defined between a sequence transition point from an incoming pressure up sequence leg and an outgoing bleed down sequence leg and a return transition point into a return path;

selectively maintaining movement of the pin along the trigger sequence path by applying pressure between a high threshold value and a low threshold value or transitioning the pin to the return path by exceeding the high threshold value or the low threshold value;

indexing the pin through the trigger sequence path into the actuation slot; and operating the downhole valve from a first position to a second position in response to the pin being shifted into the actuation slot.

11. The method of claim 10, wherein the pressure event is defined by a tubing pressure range.

12. The method of claim 10, wherein:

the indexing pattern comprises a first indexing pattern section and a second indexing pattern section; and the pin comprises a first pin movable along the first indexing pattern section and a second pin movable along the second indexing pattern section.

13. The method of claim 10, further comprising:

moving the pin from a position on the trigger sequence path to the starting slot in response to applying a tubing pressure in excess of a threshold pressure value; and initiating, after moving the pin to the starting slot, the indexing the pin through the trigger sequence path into the actuation slot.

* * * * *